US007151343B2

(12) United States Patent
Tachibana et al.

(10) Patent No.: US 7,151,343 B2
(45) Date of Patent: Dec. 19, 2006

(54) PLASMA DISPLAY PANEL HAVING PRIMING DISCHARGE CELL

(75) Inventors: Hiroyuki Tachibana, Suita (JP); Morio Fujitani, Takatsuki (JP); Yasuyuki Noguchi, Takatsuki (JP); Tetsuya Shirai, Takatsuki (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 10/505,007

(22) PCT Filed: Mar. 25, 2004

(86) PCT No.: PCT/JP2004/004171

§ 371 (c)(1),
(2), (4) Date: Aug. 19, 2004

(87) PCT Pub. No.: WO2004/086448

PCT Pub. Date: Oct. 7, 2004

(65) Prior Publication Data

US 2005/0156524 A1 Jul. 21, 2005

(30) Foreign Application Priority Data

Mar. 27, 2003 (JP) ..... 2003-088458

(51) Int. Cl.
*H01J 17/49* (2006.01)
*G09G 3/28* (2006.01)

(52) U.S. Cl. ..... 313/586; 313/582; 345/60

(58) Field of Classification Search ..... 313/586
See application file for complete search history.

(56) References Cited

U.S. PATENT DOCUMENTS

| | | | | |
|---|---|---|---|---|
| 5,754,004 | A * | 5/1998 | Miyagawa et al. | 313/585 |
| 6,313,580 | B1 * | 11/2001 | Makino | 313/582 |
| 6,496,167 | B1 * | 12/2002 | Makino | 313/582 |
| 6,605,897 | B1 * | 8/2003 | Yoo | 313/582 |
| 6,628,076 | B1 * | 9/2003 | Amatsuchi | 313/586 |
| 6,831,412 | B1 * | 12/2004 | Amatsuchi | 313/586 |
| 2003/0011307 | A1 * | 1/2003 | Otani et al. | 313/582 |
| 2005/0104807 | A1 * | 5/2005 | Tachibana et al. | 345/60 |
| 2005/0146274 | A1 * | 7/2005 | Tachibana et al. | 313/585 |

FOREIGN PATENT DOCUMENTS

| | | | |
|---|---|---|---|
| JP | 11-297211 | | 10/1999 |
| JP | 11-297215 | | 10/1999 |
| JP | 2001-195990 | | 7/2001 |
| JP | 2002-063842 | | 2/2002 |
| JP | 2002-297091 | | 10/2002 |
| JP | 2005317321 | A * | 11/2005 |
| KR | 2004088943 | A * | 10/2004 |

* cited by examiner

*Primary Examiner*—Nimeshkumar D. Patel
*Assistant Examiner*—Peter Macchiarolo
(74) *Attorney, Agent, or Firm*—Steptoe & Johnson LLP

(57) ABSTRACT

A plasma display panel has address properties stabilized. A priming discharge is performed between auxiliary electrodes (18), which are formed on a front substrate (1) and coupled with scan electrodes (6), and priming electrodes (14) formed on a back substrate (2). And on the front substrate (1), a dielectric layer (4) is made thinner in regions corresponding to priming cells (gap parts 13) than in regions corresponding to cell parts (11). As a result, the priming discharge has a wider margin, and a supply of priming particles to the discharge cells is stabilized, whereby a discharge delay during the addressing is reduced, and the address properties are stabilized.

4 Claims, 6 Drawing Sheets

PLASMA DISPLAY PANEL HAVING PRIMING DISCHARGE CELL

TECHNICAL FIELD

The present invention relates to plasma display panels used for wall-hung TVs and large-size monitors.

BACKGROUND ART

An AC surface discharge type plasma display panel (hereinafter referred to as PDP), which is a typical AC type PDP, is formed of a front plate made of a glass substrate having scan electrodes and sustain electrodes provided thereon for a surface discharge, and a back plate made of a glass substrate having data electrodes provided thereon. The front plate and the back plate are disposed to face each other in parallel in such a manner that the electrodes on both plates form a matrix, and that a discharge space is formed between the plates. And the outer part of the plates thus combined is sealed with a sealing member such as a glass frit. Between the substrates, discharge cells partitioned by barrier ribs are formed, and phosphor layers are provided in the cell spaces formed by the barrier ribs. In a PDP with this structure, ultraviolet rays are generated by gas discharge and used to excite and illuminate phosphors for red, green and blue, thereby performing a color display (See Japanese Laid-Open Patent Application No. 2001-195990).

In this PDP, one field period is divided into a plurality of sub fields, and sub fields during which to illuminate the phosphors are combined so as to drive the PDP for a gradation display. Each sub field consists of an initialization period, an address period and a sustain period. For displaying image data, each electrode is applied with signals different in waveform between the initialization, address and sustain periods.

In the initialization period, all scan electrodes are applied with, e.g. a positive pulse voltage so as to accumulate a necessary wall charge on a protective film provided on a dielectric layer covering the scan electrodes and the sustain electrodes, and also on the phosphor layers.

In the address period, all scan electrodes are scanned by being sequentially applied with a negative scan pulse, and when there are display data, a positive data pulse is applied to the data electrodes while the scan electrodes are being scanned. As a result, a discharge occurs between the scan electrodes and the data electrodes, thereby forming a wall charge on the surface of the protective film provided on the scan electrodes.

In the subsequent sustain period, for a set period of time, a voltage enough to sustain a discharge is applied between the scan electrodes and the sustain electrodes. This voltage application generates a discharge plasma between the scan electrodes and the sustain electrodes, thereby exciting and illuminating the phosphor layers for a set period of time. In a discharge space where no data pulse has been applied during the address period, no discharge occurs, causing no excitation or illumination of the phosphor layers.

In this type of PDP, a large delay in discharge occurs during the address period, thereby making the address operation unstable, or completion of the address operation requires a long address time, thereby spending too much time for the address period. In an attempt to solve these problems, there have been provided a PDP in which auxiliary discharge electrodes are formed on a front plate, and a discharge delay is reduced by a priming discharge generated by an in-plane auxiliary discharge on the front plate side, and a method for driving the PDP (See Japanese Laid-Open Patent Application No. 2002-297091).

However, in these conventional PDPs, when the number of lines is increased as a result of achieved higher definition, more time must be spent for the address time and less time must be spent for the sustain period, thereby making it difficult to secure the brightness when higher definition is achieved. Furthermore, when the partial pressure of xenon (Xe) is increased to achieve higher brightness and higher efficiency, a discharge initiation voltage rises so as to increase a discharge delay, thereby deteriorating address properties. Since the address properties are greatly affected by the address process, it is demanded to reduce a discharge delay during the addressing, thereby accelerating the address time.

In spite of this demand, in conventional PDPs performing a priming discharge in the front plate surface, a discharge delay during the addressing cannot be reduced sufficiently; the operating margin of an auxiliary discharge is small; and a false discharge is induced to make the operation unstable. Moreover, since the auxiliary discharge is performed in the front plate surface, more priming particles than necessary for priming are applied to an adjacent discharge cell, thereby causing crosstalk.

The present invention, which has been contrived in view of the aforementioned problems, has an object of providing a PDP for performing a priming discharge between the front plate and the back plate to stably generate a priming discharge, thereby having stable address properties even when higher definition is achieved.

SUMMARY OF THE INVENTION

In order to achieve the object, a PDP of the present invention comprises a first electrode and a second electrode which are disposed in parallel with each other on a first substrate, and which are covered with a dielectric layer;

a third electrode disposed on a second substrate in a direction orthogonal to the first electrode and the second electrode, the second substrate being disposed to face the first substrate with a discharge space therebetween; a fourth electrode disposed on the second substrate in such a manner as to be parallel with the first electrode and the second electrode; and a first discharge space and a second discharge space which are formed on the second substrate by being partitioned by a barrier rib, wherein a main discharge cell for performing a discharge with the first electrode, the second electrode and the third electrode is formed in the first discharge space, and a priming discharge cell for performing a discharge with the fourth electrode and at least one of the first electrode and the second electrode is formed in the second discharge space, and in the dielectric layer, a thickness in a region corresponding to the second discharge space is made smaller than a thickness in a region corresponding to the first discharge space.

With this structure, in a priming discharge in the vertical direction between the first substrate and the second substrate, thinning a portion of the dielectric layer that corresponds to the second discharge space, which is the priming discharge space, increases the capacitance of the dielectric layer so as to raise the value of an effective voltage to be applied to discharge gaps, thereby making it possible to stimulate generation of a priming discharge. As a result, increasing the operating margin of the priming discharge and reducing a discharge voltage can form a stable priming discharge while reducing influence on the surroundings, such as crosstalk, thereby achieving a PDP with excellent address properties so as to be compatible with high definition.

DETAILED DESCRIPTION OF PREFERRED EMBODIMENTS

A PDP according to an embodiment of the present invention will be described as follows with reference to accompanying drawings.

(First Exemplary Embodiment)

Figure 1:
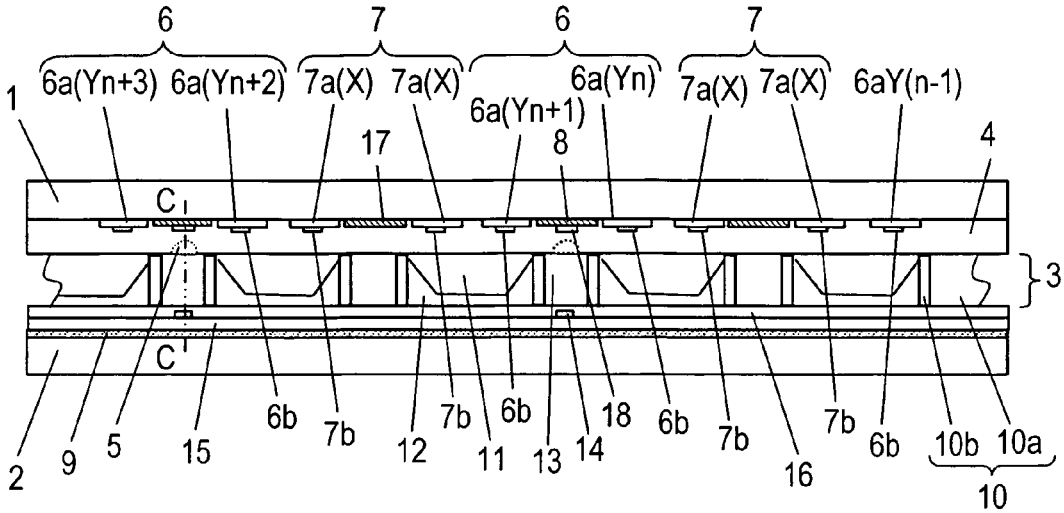
FIG. 1 is a cross sectional view of a PDP according to a first embodiment of the present invention.
Figure 2:
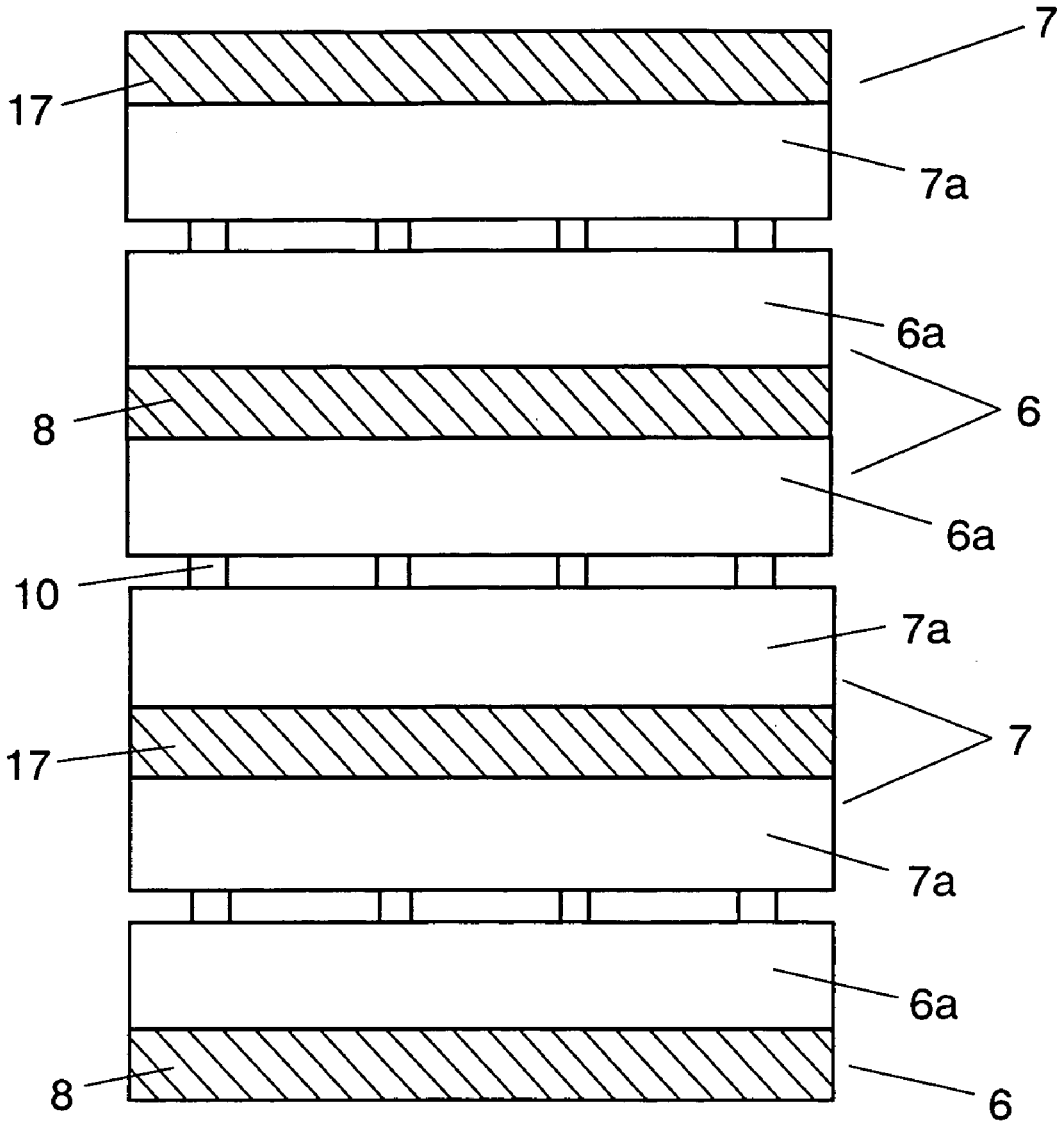
FIG. 2 is a schematic plan view showing an electrode arrangement on a front substrate side of the PDP according to the first embodiment of the present invention.
Figure 3:
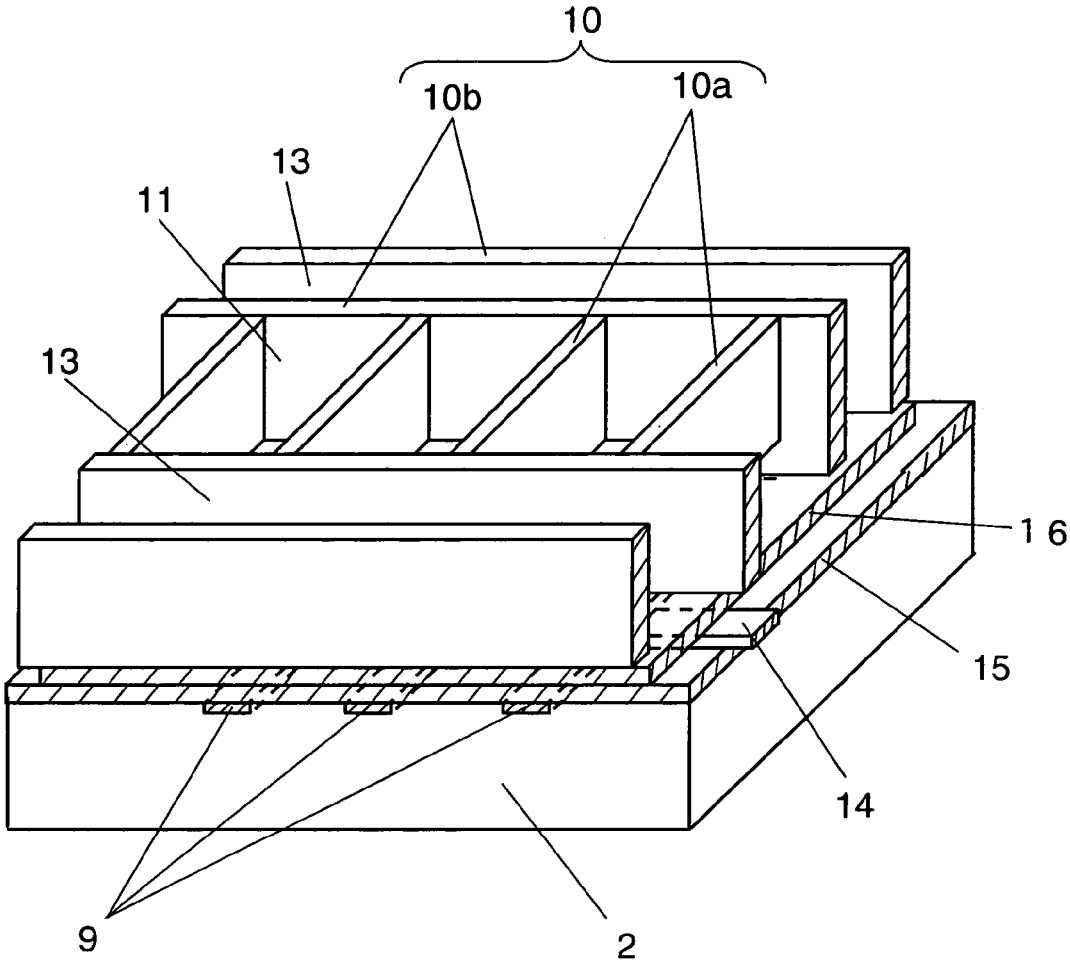
FIG. 3 is a schematic perspective view showing a back substrate side of the PDP according to the first embodiment of the present invention.
Figure 4:
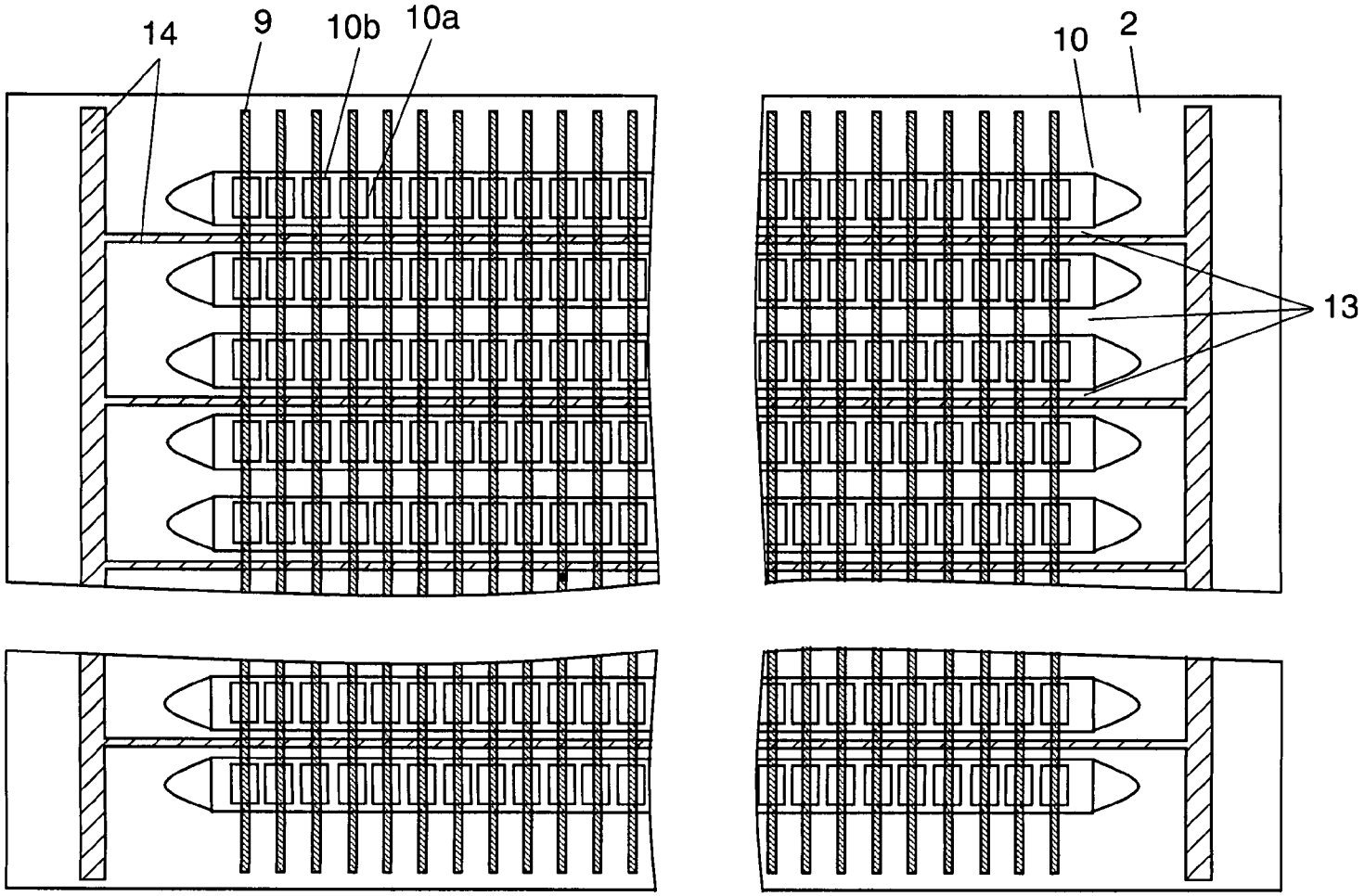
FIG. 4 is a schematic plan view showing a back substrate side of the PDP according to the first embodiment of the present invention.

FIG. 1 is a cross sectional view of a PDP according to a first embodiment of the present invention, FIG. 2 is a schematic plan view showing an electrode arrangement on a front substrate side, which is a first substrate side, FIG. 3 is a schematic perspective view showing a back substrate side, which is a second substrate side and FIG. 4 is a plan view thereof.

As shown in FIG. 1, front substrate 1 which is a first substrate made of glass, and back substrate 2 which is a second substrate made of glass are disposed to face each other with discharge space 3 therebetween, and discharge space 3 is sealed with neon (Ne), xenon (Xe) and the like as gasses for irradiating ultraviolet rays by discharge. On front substrate 1, a group of belt-shaped electrodes consisting of pairs of scan electrodes 6 as first electrodes and sustain electrodes 7 as second electrodes are disposed in parallel with each other in such a manner as to be covered with dielectric layer 4 and protective layer (not illustrated). Scan electrodes 6 and sustain electrodes 7 are respectively formed of transparent electrodes 6*a* and 7*a*, and metal bus bars 6*b* and 7*b*, which are respectively laid on transparent electrodes 6*a* and 7*b*, and which are made of silver or the like for improving conductivity. As shown in FIGS. 1 and 2, scan electrodes 6 and sustain electrodes 7 are disposed alternately, two by two, so that scan electrode 6—scan electrode 6—sustain electrode 7—sustain electrode 7, . . . are arranged in that order, and auxiliary electrodes 18 are each provided between two adjacent scan electrodes 6. In addition, light absorption layers 8 for improving a contrast at the time of illumination are each disposed between two adjacent sustain electrodes 7, and between two adjacent scan electrodes 6. Auxiliary electrodes 18 are connected with scan electrodes 6 at a non-display part (end part) of the PDP. As shown in FIGS. 1, 3 and 4, back substrate 2 is provided thereon with a plurality of belt-shaped data electrodes 9 which are third electrodes disposed in parallel with each other in the direction orthogonal to scan electrodes 6 and sustain electrodes 7. Back substrate 2 is further provided thereon with barrier ribs 10 for partitioning a plurality of discharge cells formed by scan electrodes 6, sustain electrodes 7 and data electrodes 9. Barrier ribs 10 are formed of longitudinal rib parts 10*a* extending in the direction orthogonal to scan electrodes 6 and sustain electrodes 7 provided on front substrate 1, namely in the direction parallel to data electrodes 9, and of lateral rib parts 10*b* crossing longitudinal rib parts 10*a* to form cell spaces 11, which are first discharge spaces, and also to form gap parts 13 between cell spaces 11. Cell spaces 11 are provided with phosphor layers 12 to form discharge cells.

As shown in FIG. 3, gap parts 13 formed on back substrate 2 are continuous in the direction orthogonal to data electrodes 9. And priming electrodes 14 which are fourth electrodes for causing a discharge between front substrate 1 and back substrate 2 are disposed, in the direction orthogonal to data electrodes 9, exclusively in gap parts 13 corresponding to regions where scan electrodes 6 are adjacent to each other, so as to form priming cells which are second discharge spaces. Priming electrodes 14 are formed on dielectric layer 15 covering data electrodes 9, and dielectric layer 16 is formed to cover priming electrodes 14. Thus, priming electrodes 14 are disposed closer to gap parts 13 than data electrodes 9. With this structure, a priming discharge is performed between auxiliary electrodes 18 and priming electrodes 14 formed on back substrate 2 side.

As shown in FIGS. 1 and 2, in front substrate 1, dielectric layer 4, which covers scan electrodes 6 and sustain electrodes 7, is provided thereon with trenches 5 at locations corresponding to priming electrodes 14 on back substrate 2 in such a manner that trenches 5 are in parallel with priming electrodes 14 and auxiliary electrodes 18. In other words, in the present embodiment, dielectric layer 4 formed on front substrate 1 which is the first substrate is made thinner in regions corresponding to priming cells (gap parts 13) which are the second discharge spaces than in regions corresponding to cell spaces 11 which are the first discharge spaces. Consequently, in the regions with trenches 5 where dielectric layer 4 is made thinner, when the capacitance of dielectric layer 4 is increased, and a voltage is applied between auxiliary electrodes 18 and priming electrodes 14, the value of an effective voltage to be applied on the discharge gaps can be increased. This facilitates generation of a priming discharge, and reduces variations in discharge in priming cells having a long and narrow shape, thereby supplying priming particles to each of cell spaces 11 uniformly. The shape of trenches 5 may be a semioval, a square prism, etc., other than a semicircle shown in FIG. 1, and the width, depth and shape of trenches 5 are determined in accordance with design requirements for optimizing priming discharge. It is preferable that the respective center lines of trenches 5, priming electrodes 14 and auxiliary electrodes 18 agree with each other as shown in line C—C of FIG. 1.

A method for displaying image data on the PDP will be described as follows.

In order to drive the PDP, one field period is divided into a plurality of sub fields having a weight of an illumination period based on the binary system, and a gradation display is performed by a combination of sub fields during which to illuminate phosphors. Each sub field consists of an initialization period, an address period and a sustain period.

Figure 5:
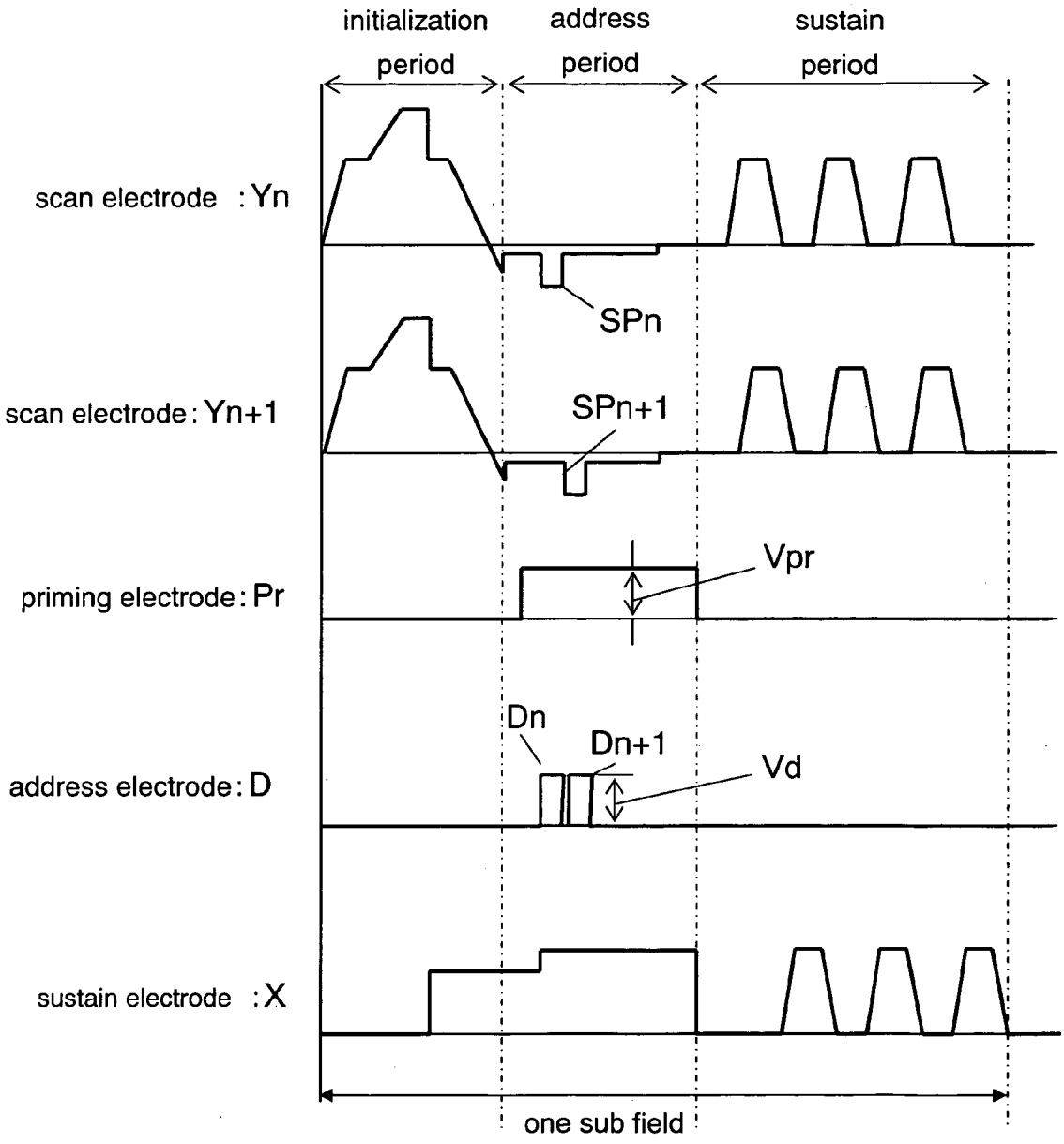
FIG. 5 is a waveform chart showing an example of waveforms for driving the PDP according to the first embodiment of the present invention.

FIG. 5 is a waveform chart showing an example of waveforms for driving the PDP according to the present invention. First of all, during the initialization period, in priming cells having priming electrodes Pr (priming electrodes 14 shown in FIG. 1), all scan electrodes Y (scan electrodes 6 shown in FIG. 1) are applied with a positive pulse voltage so as to perform an initialization between an auxiliary electrodes (auxiliary electrodes 18 shown in FIG. 1) and priming electrodes Pr. During the subsequent address period, priming electrodes Pr are constantly applied with a positive potential. Consequently, in the priming cells, when scan electrode $Y_n$ is applied with a scan pulse $SP_n$, a priming discharge occurs between priming electrodes Pr and the auxiliary electrodes.

Then, scan electrode $Y_{n+1}$ of the n+1th discharge cells is applied with a scan pulse $SP_{n+1}$; however, since a priming discharge has occurred immediately before this, a discharge delay in the n+1th discharge cells during the addressing can be reduced. Although the driving sequence in one sub field has been described hereinbefore, the other sub fields have the same operation principle. In the drive waveforms shown in FIG. 5, applying a positive voltage to priming electrodes Pr during the address period can perform the aforementioned operations more securely. The voltage to be applied to priming electrodes Pr during the address period is preferably set at a larger value than the data voltage value to be applied to address electrodes D.

As described hereinbefore, in the present embodiment, a priming discharge occurs in the vertical direction between auxiliary electrodes 18 on front substrate 1 and priming electrodes 14 on back substrate 2. Furthermore, dielectric layer 4 is partly made thinner by providing trenches 5 in portions corresponding to gap parts 13 in which to cause a priming discharge on front substrate 1. This structure can increase the capacitance of dielectric layer 4, and when a voltage is applied between auxiliary electrodes 18 and priming electrodes 14, the value of an effective voltage to be applied in the discharge gaps can be increased, thereby stimulating generation of a priming discharge. Consequently, while securing the conventional operating margin, discharge intensity can be diminished by decreasing an applied voltage, thereby reducing influence of a priming discharge on the surroundings, such as crosstalk. In a case that the same applied voltage as in the conventional PDPs is applied, the discharge operating margin can be larger than in the conventional cases. It goes without saying that adjusting the applied voltage can bring about both the effect of reducing crosstalk and the effect of increasing the operating margin. This results in more stabilized address properties in a PDP with high definition.

(Second Exemplary Embodiment)

Figure 6:
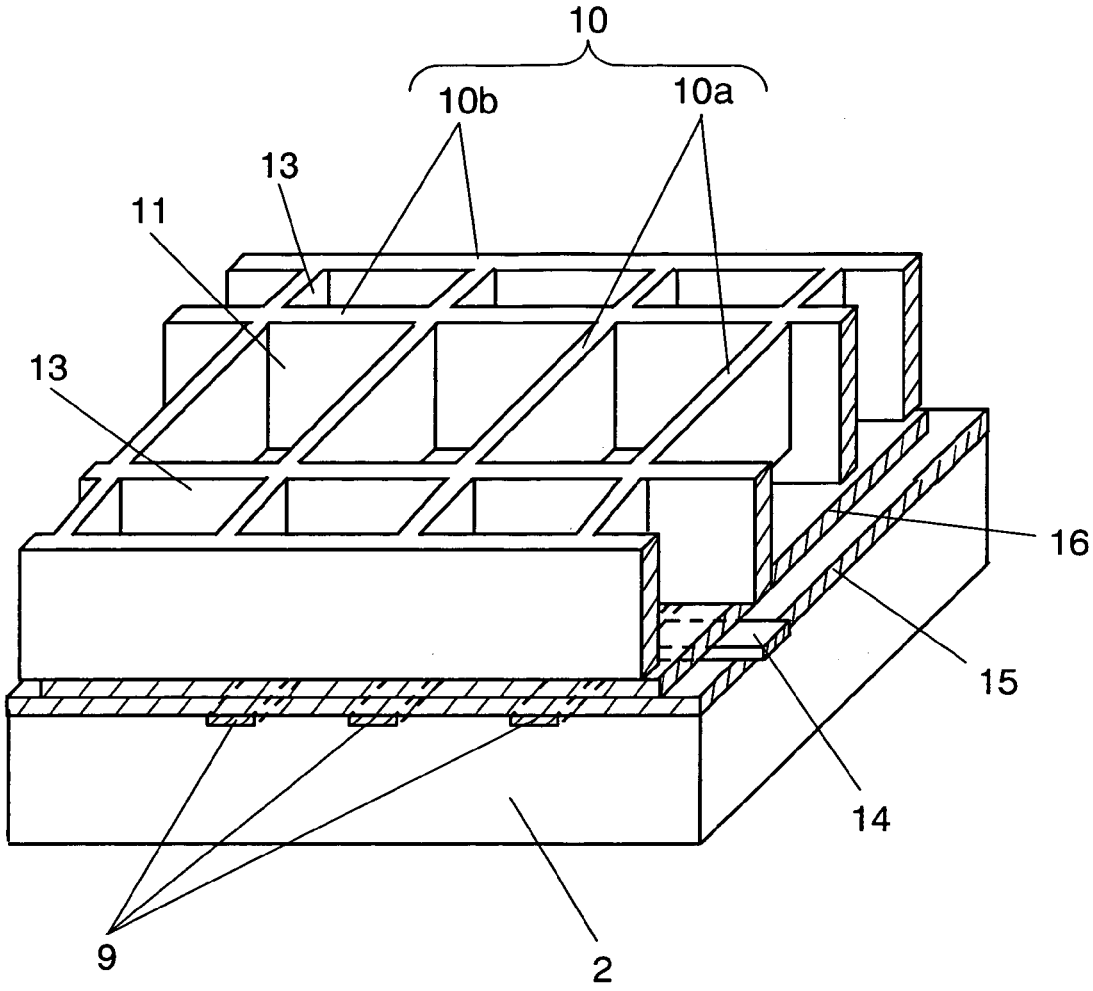
FIG. 6 is a schematic perspective view showing a back substrate side of a PDP according to a second embodiment of the present invention.

FIG. 6 is a schematic perspective view showing a back substrate side of a PDP according to a second embodiment of the present invention. In the present embodiment, gap parts 13 for forming priming cells are shaped into a parallel cross pattern with longitudinal rib parts 10*a* and lateral rib parts 10*b*.

In a case that gap parts 13 are formed continuously with lateral rib parts 10*b* only as described in the first embodiment, in intersections between longitudinal rib parts 10*a* and lateral rib parts 10*b*, distortion may appear on lateral rib parts 10*b* by heat shrinkage of longitudinal rib parts 10*a* in particular so as to decrease plane precision in barrier ribs 10, thereby adversely affecting crosstalk and the like. For this, it is effective to provide longitudinal rib pars 10*a* also to gap parts 13 as shown in FIG. 6.

On the other hand, when longitudinal rib parts 10*a* and lateral rib parts 10*b* are shaped into a parallel cross pattern with the same height, a priming discharge is divided by longitudinal rib parts 10*a*, thereby making it difficult to perform a stable discharge along priming electrodes 14. In addition, there is a drawback in exhaust from gap parts 13, which are sealed.

In contrast, according to the second embodiment of the present invention, similar to the first embodiment, the provision of trenches 5 continuous in parallel with priming electrodes 14 on the surface of dielectric layer 4 on front substrate 1 enables a priming discharge to expand continuously along trenches 5, thereby achieving generation of a stable priming discharge and also performing a smooth exhaust from the priming cells. This can not only form barrier ribs 10 with high precision on back substrate 2, but also exert the same effects as in the first embodiment of the present invention, and a crosstalk reduction effect is particularly large.

INDUSTRIAL APPLICABILITY

A plasma display panel of the present invention can stimulate generation of a priming discharge and expand the operating margin of the priming discharge so as to reduce a discharge delay during the addressing, thereby having more stabilized address properties. Therefore, this panel is useful as a plasma display panel and the like used for wall-hung TVs and large-size monitors.

The invention claimed is:

1. A plasma display panel comprising:

a first electrode and a second electrode parallel with each other on a first substrate, and covered with a first dielectric layer (4);

a third electrode on a second substrate in a direction orthogonal to the first electrode and the second electrode, the second substrate facing the first substrate with a discharge space therebetween;

a fourth electrode on the second substrate parallel to the first electrode and the second electrode, and covered with a second dielectric layer (16); and a first discharge space and a second discharge space on the second substrate partitioned apart by a barrier rib;

a main discharge cell for performing a discharge with the first electrode, the second electrode and the third electrode, in the first discharge space, and a priming discharge cell for performing a discharge with the fourth electrode and at least one of the first electrode and the second electrode, in the second discharge space, wherein the plasma display panel is configured so that a thickness of the first dielectric layer (4) is thinner where there is a trench (5) over second discharge space (13) than a thickness of the first dielectric layer (4) in the first discharge space (11).

2. The plasma display panel according to claim 1, wherein the barrier rib comprises a longitudinal rib part extending orthogonal to the first electrode and the second electrode, and a lateral rib part parallel with the first electrode and the second electrode, to form a continuous gap part, and the gap part is the second discharge space.

3. The plasma display panel according to claim 1, wherein the thickness of the second dielectric layer on the fourth electrode in the second discharge space has a portion continuously of small thickness in said second discharge space and parallel with the fourth electrode.

4. The plasma display panel according to claim 3, wherein the first dielectric layer located in the second discharge space includes the small thickness portion formed in the shape of a trench.

* * * * *

UNITED STATES PATENT AND TRADEMARK OFFICE

CERTIFICATE OF CORRECTION

PATENT NO. : 7,151,343 B2
APPLICATION NO. : 10/505007
DATED : December 19, 2006
INVENTOR(S) : Hiroyuki Tachibana et al.

It is certified that error appears in the above-identified patent and that said Letters Patent is hereby corrected as shown below:

Column 6, line 49, penultimate line of claim 1, change "layer (4) in" to read --layer (4) over--.

Signed and Sealed this

Tenth Day of April, 2007

JON W. DUDAS
*Director of the United States Patent and Trademark Office*